United States Patent [19]

Drimmer

[11] 4,213,391

[45] Jul. 22, 1980

[54] ANTI-TANK MINE WITH PERIPHERAL CHARGE INITIATION

[75] Inventor: Bernard E. Drimmer, Brentwood, Md.

[73] Assignee: The United States of America as represented by the Secretary of the Army, Washington, D.C.

[21] Appl. No.: 353,696

[22] Filed: May 7, 1953

[51] Int. Cl.[2] ..... F42B 23/04

[52] U.S. Cl. ..... 102/8; 102/DIG. 2

[58] Field of Search ..... 102/8, 22, 23, 24, 52, 102/DIG. 2

[56] References Cited

U.S. PATENT DOCUMENTS

| | | | |
|---|---|---|---|
| 632,027 | 8/1899 | Smith | 102/52 |
| 1,189,011 | 6/1916 | Smith | 102/38 |
| 1,440,601 | 1/1923 | Holran | 102/24 |
| 2,137,436 | 11/1938 | Barnhart | 102/52 |
| 2,407,093 | 9/1946 | Mohaupt | 102/24 |
| 2,604,042 | 7/1952 | Cook | 102/24 |
| 2,622,528 | 12/1952 | Lawrence | 102/24 |
| 2,652,775 | 9/1953 | Swanson | 102/20 |
| 2,656,792 | 10/1953 | Dumas | 102/8 |
| 2,809,585 | 10/1957 | Moses | 102/24 |

FOREIGN PATENT DOCUMENTS

| | | | |
|---|---|---|---|
| 677824 | 8/1952 | United Kingdom | 102/20 |

OTHER PUBLICATIONS

Clark, George B., Technical Pub. No. 2157, American Institute of Mining and Met. Eng. Mar. 1947.

*Primary Examiner*—Charles T. Jordan

*Attorney, Agent, or Firm*—Nathan Edelberg; Robert P. Gibson; Max Yarmovsky

EXEMPLARY CLAIM

1. In a demolition unit, a closed container having a shallow depth relative to its transverse cross section, and having a high explosive charge contained therein, a completely embedded non-explosive shock absorbing mass centrally located within said explosive and extending laterally to within a short distance of the side walls of said container, a facing plate projectile of substantial density secured to and substantially coextensive with the top wall of said container and in contact with said explosive, and means below said non-explosive mass for initiating said explosive charge, the detonation wave of said explosive charge striking said face plate as a flat wave to propel said plate intact toward a target.

10 Claims, 3 Drawing Figures

ANTI-TANK MINE WITH PERIPHERAL CHARGE INITIATION

The invention described herein may be used by and for the Government for Governmental purposes, without the payment to me of any royalty thereon.

This invention relates to improvements in land mines and more particularly to a mine of the type in which a relatively dense and heavy plate or disc is projected forwardly or upwardly, intact, and at a high velocity when the mine is exploded.

A mine of the type which forms the basis of this invention may or may not be concealed and camouflaged by being buried beneath the surface of the earth and is generally actuated by the weight of a vehicle, as a tank, setting off a fuze attached to the mine. The fuze in turn detonates a high explosive which produces a shock wave or advancing detonation front. In a homogeneous explosive charge, the detonation rate within the charge is constant for all practical purposes and the detonation front is concave and assumes the shape of an expanding sphere with its center at the point of initiation. Since the center of the plate is first subjected to the wave front, this portion of the plate is propelled forwardly ahead of the outer sections, thereby causing fragmentation of the plate. However, experience has indicated that optimum penetration of a target is obtained when the plate remains intact.

It is accordingly an object of this invention to provide a land mine in which a facing plate is propelled forwardly and in one piece.

It is also an object of this invention to provide for a novel arrangement of an explosive charge in a land mine to guard against fragmentation of the facing plate when it is subjected to the shock wave of the exploded charge.

It is also a further object of this invention to provide for a novel arrangement of an explosive charge in a land mine to alter the shape of the detonation wave in a manner to obtain a shock wave to propel the facing plate, which wave is more nearly convex or flat rather than concave.

It is also a further and additional object of this invention to provide a land mine having an explosive charge of relatively narrow depth, and including an inert mass located within the high explosive in a manner to alter the shape of the detonation wave from concave to convex, preferably, or flat by peripheral or circumferential initiation of the charge above the inert mass whereby the increased energy concentration of the shock wave propels a facing plate without fragmentizing it, and with materially increased velocity and penetrating or destructive effect.

Figure 1:
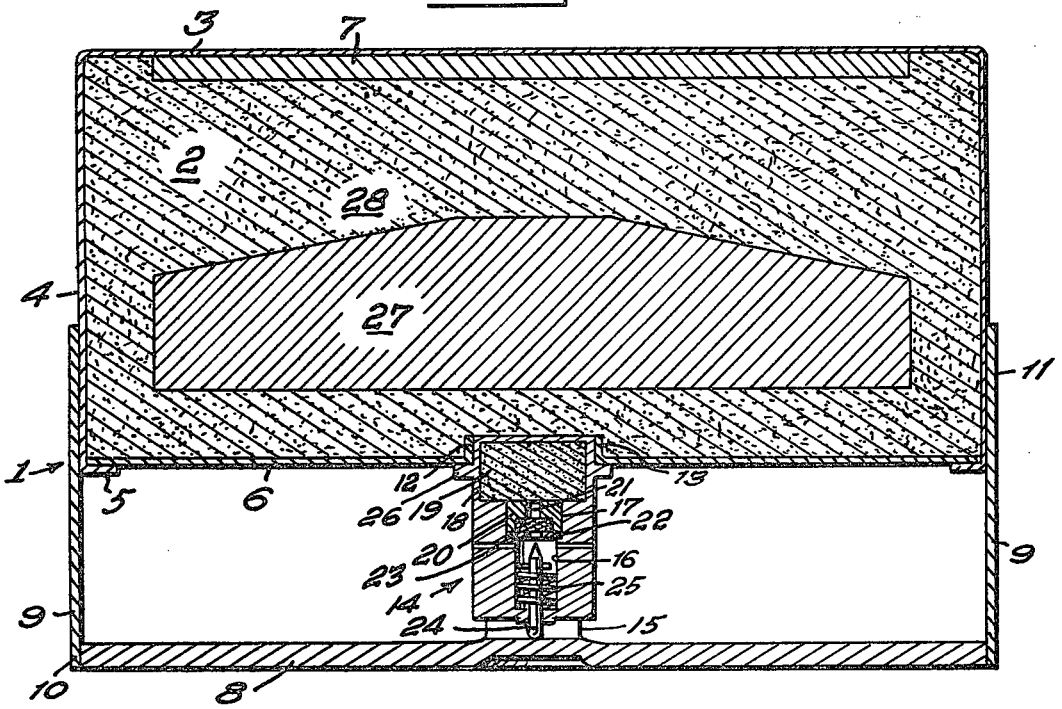

With these and other objects in view which will become apparent as the specification develops, reference is made to the accompanying drawings forming a part of this invention, wherein like numerals have been used to designate like or corresponding parts throughout, and in which FIG. 1 is longitudinal section through a land mine showing a typical arrangement of facing plate, explosive charge, inert mass and charge initiating means.

Figure 2:
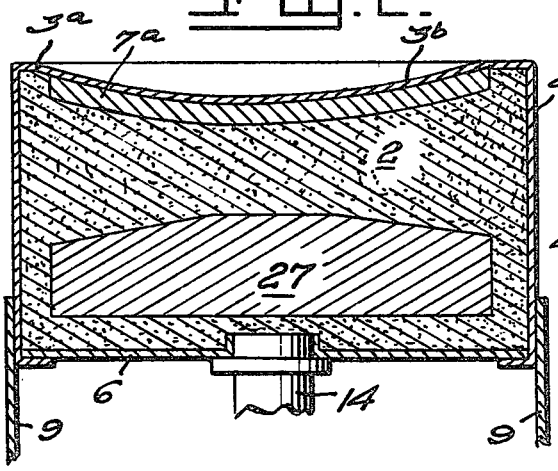
Figure 3:
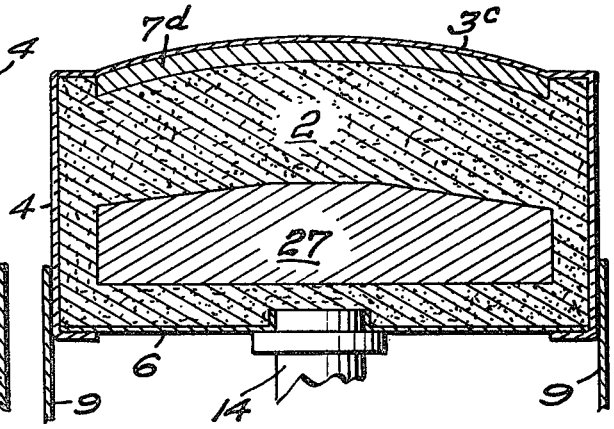

FIG. 2 is a section corresponding to FIG. 1 and showing a modification in which the facing plate and top wall are coextensively depressed or made concave, and FIG. 3 is another modification in which the facing plate and top wall are convex.

Referring to the drawing, and to FIG. 1 in particular, 1 designates the land mine generally in its entirety, and which includes a relatively shallow, cylindrical container filled with a high velocity (Vf) explosive 2, such as Pentolite, TNT, or Composition B, which is a mixture of RDX and TNT, and having a top wall 3 and side wall 4, the side wall being flanged or struck inwardly as at 5 to provide a support for a bottom wall 6. A flat, disc shaped heavy plate 7 of metal or of any suitably dense substance having a thickness greater than the container wall, and of slightly reduced diameter, is secured to the underside of top wall 3 in any convenient manner, as by spot welding.

A support for the entire land mine is provided and which is arranged to accommodate a detonator for initiating the main explosive charge at the central point of its lower surface. This support comprises a substantially heavy disc-like plate 8 of the same diameter as the land mine 1, and axially spaced from lower wall 6. A sleeve 9 having air escape louvers (not shown) and having an inner diameter equal to the outer diameter of land mine 1 has its inner lower end 10 secured, as by spot welding, to the peripheral edge of plate 8, and its upper end 11 overlapping side wall 4 for a substantial distance and secured thereto in any convenient manner.

Bottom wall 6 is provided with a central opening 12, and is struck up about opening 12 to provide a flange 13. A cylindrical fuze or detonator body 14 snugly engages flange 13 and extends downwardly to within a short distance of flat plate 8, being supported above plate 8 by a spider 15 collapsible by the weight of a vehicle. Alternatively a helical spring may be used. Detonator body 14 is provided in its lower half with a small diameter axial bore 16, communicating with a central, shallow counterbore 17 of larger diameter, which in turn opens at its upper end into a second counterbore 18 again of larger diameter than counterbore 17 for receiving a detonating substance 19 of relatively high sensitivity. An insert 20 is received within counterbore 17 and is provided with an upper flash passage 21 and a lower space 22 for receiving an impact responsive igniter 23 of low sensitivity. A firing pin 24 is received within bore 16 and is urged into normal position by a spring 25 such that its lower end abuts plate 8 and its upper end is spaced axially below igniter 23. An annular ring 26 snugly received about detonator body 14, has its upper surface engaging the lower surface of bottom wall 6 to provide additional means for securing the detonator or fuze body to the mine.

In order to shape the detonation wave so as to alter it from a concave configuration with respect to point of initiation to a convex or a flat wave, an inert, non-explosive, shock wave absorbing substance or insert 27 is received within the explosive charge. The substance 27 may be any suitable non-explosive material compatible with the high explosive; e.g., bakelite, vermiculite, or an inorganic powder, and is formed as a shallow cylinder concentric within the side wall and with its top surface 28 either flat, frusto-conical, or convex. The top and bottom surfaces of the inert material are spaced from the upper and lower walls of the container. For a reason to be later explained it is important to note that the vertical peripheral surface of inert material 27 is spaced inwardly from the side wall 4 of the explosive charge only sufficiently to insure continuity of detonation and propagation of the shock wave.

FIG. 2 defines a land mine similar in construction and arrangement to the land mine in FIG. 1, with the exception that the central portion 3*b* of top wall 3*a* is concave, the concavity extending radially to within a short distance of side wall 4. A concave plate 7*a*, coextensive with the concavity of portion 3*b*, is secured in any convenient manner to the under surface of top wall 3*a*.

FIG. 3 is another modification similar in construction and arrangement to FIGS. 1 and 2 with the exception that the top wall 3*c* is convex, rather than concave, and plate 7*d*, secured to it in the manner of plates 7 and 7*a* in FIGS. 1 and 2 respectively, is also coextensively convex.

The three species illustrated are substantially similar in operation, functioning in the following manner. Assume an organization similar to FIG. 1 but with the inert material removed. Initiation of the main high explosive charge, in the center of the flat surface of the mine opposed to the facing plate, produces a detonation wave which is semi-spherical, and concave with respect to the point of initiation. As the wave progresses, contact is first made so that the bottom surface of the facing plate becomes tangent to the wave envelope. The wave, in effect, continues to roll along the plate surface, and before the plate is released or propelled, its central area is forced outwardly and becomes convex. Since each structural element in the facing plate tends to take a path approximately normal to the resulting convex surface, the resulting divergance sets up shearing stresses to cause fragmentation or shattering of the plate.

With the inert substance in place, initiation of the main explosive charge again produces a spherical wave which is concave with respect to the point of initiation. However, the inert material absorbs the "peak" or central portion of the shock wave, and the remainder of the wave travels radially outwardly through the explosive substance lying between the lower surface of the inert material and the bottom wall of the demolition unit. Actually complete absorption is not achieved. Instead the intensity of the shock wave through the inert material is degraded so that upon emerging from the opposite end of the material the wave will not have sufficient energy to cause the high explosive to detonate. Additionally the detonation rate of the high explosive may compare with the rate of shock propagation through the inert material in such a manner that the detonation will proceed around the inert material and reach the opposite surface before the shock wave passing through the inert material actually reaches that surface.

The upper surface of the inert mass may be shaped to approximate the contour of the wave front as it progresses through the inert material to increase the length of the path taken by the shockwave in the inert material thereby maximizing the delay time and the degradation of intensity.

As the detonation wave rolls along the bottom of the inert material, it progresses rapidly and in turn detonates that portion of the high explosive defined by the annulus between the peripheral edges of the inert material and the outer diameter of the mine. As previously indicated only sufficient high explosive need be provided at this location to effect continuity of detonation. There results, therefore, a phenomenon which may be described as a "bending" of the wave about the lower horizontal and vertical surfaces of the inert mass, until peripheral or circumferential initiation of the explosive about the inert mass occurs about a circle defined approximately by the upper peripheral edge of the inert mass. A detonation front develops which in any cross section may be seen as two waves each having a point of origin at diametral points on the circle of initiation, and converging at their lower ends, while diverging at the upper portions which contact the facing plate. The entire wave front, of course, is in reality a toroidal wave front expanding from the periphery of initiation. The effect of this wave front is to subject the facing plate with a propulsive force which engages the plate at its outer periphery and progressively rolls along the surface of the plate toward its geometrical center. The wave front is thus convex with respect to the original point of initiation and the plate is propelled forwardly in intact condition.

The operation of the mine of FIG. 2 is the same as that illustrated in FIG. 1 however the edges of the plate, as seen in cross section, bend toward one another to a greater extent than FIG. 1. The plate again remains intact but the size of the penetration is smaller in area.

Likewise in FIG. 3, the convex shape of the facing plate is such as to compensate for the tendency of the plate edges to bend inwardly. Here, of course, the penetration is greater in area than in FIG. 2.

Although the mine has been shown as cylindrical this is merely exemplary. It is within the purview of this invention to make it triangular, square or any suitable regular polygonal configuration. In like manner the shape of the insert may be altered to conform to the configuration of its corresponding explosive container. The container may be of any suitable metal, and the facing plate may be a dense steel or iron. Additionally it is contemplated that the mine may be non-metallic to avoid detection and the facing plate may be of a non-metallic substance of sufficient density. Other modifications and alterations of the structure disclosed herein will be apparent to one skilled in the art, and it is obvious that the same may be made without departing from the spirit and scope of the invention defined in the following claims.

I claim:

1. In a demolition unit, a closed container having a shallow depth relative to its transverse cross section, and having a high explosive charge contained therein, a completely embedded non-explosive shock absorbing mass centrally located within said explosive and extending laterally to within a short distance of the side walls of said container, a facing plate projectile of substantial density secured to and substantially coextensive with the top wall of said container and in contact with said explosive, and means below said non-explosive mass for initiating said explosive charge, the detonation wave of said explosive charge striking said face plate as a flat wave to propel said plate intact toward a target.

2. The demolition unit of claim 1 wherein the top wall of said container and said facing plate are planar.

3. The demolition unit of claim 1 wherein the top wall of said container and said facing plate are centrally depressed.

4. The demolition unit of claim 1 wherein the central portion of the top wall of said container and said facing plate are convex.

5. In a demolition unit, a container comprising a side wall and top and bottom walls, said container having a small depth relative to its transverse cross section, a detonating explosive charge occupying the space formed by said container, a facing plate projectile secured to the under surface of said top wall and embedded in said explosive, a wave shaping inert shock absorbing mass centrally located in and completely surrounded by said explosive charge, and means below said inert mass for initiating said explosive charge, a detonating wave formed upon initiation of said explosive charge striking said facing plate as a flat wave to propel said plate intact toward a target.

6. The demolition unit of claim 5 wherein said top wall and said facing plate are centrally depressed.

7. The demolition unit of claim 5 wherein said top wall and said facing plate each define a flat surface.

8. The demolition unit of claim 5 wherein the central portion said top wall, and said facing plate, are convex.

9. A demolition unit comprising a container having a flat bottom and side walls of uniform height extending upwardly from the periphery of said bottom to define a chamber having a vertical central axis of symmetry, said chamber having a shallow depth relative to its transverse cross section, a high explosive charge filling said chamber, an insert of inert shock-absorbing material completely embedded within said charge to absorb the peak of the detonation wave and by peripheral initiation alter the wave shape, said insert having a vertical axis of symmetry coincident with the axis of symmetry of said container, and a flat bottom spaced within a short distance of the detonation means and parallel with the bottom of said container, a plate projectile of uniform thickness mounted over and in contact with said charge and in substantially coextensive spaced parallel relation with said insert, and means operable to detonate said charge at a point on said axis below said insert, the detonation wave from said high explosive charge striking said facing plate as a flat wave to propel said plate intact toward a target.

10. In a land mine, a container having a continuous enclosing side wall and top and bottom walls, a fuze located on the axis of and in contact with said bottom wall, a relatively thin first high explosive layer in contact with said fuze for initiation thereby and covering said bottom wall, a shock-absorbing mass axially disposed on said first explosive layer and uniformly spaced from said side wall, a body of high explosive between said side wall and said shock-absorbing mass, a second layer of high explosive on said shock-absorbing mass, an axially positioned plate projectile adjacent said top wall and in contact with said second explosive layer, said first and second explosive layers forming with said body of explosive a continuous detonation path around said shock-absorbing mass from said fuze to said plate projectile, a detonating wave formed upon initiation of said explosive charge striking said plate projectile as a substantially flat wave to propel said plate intact toward a target.

* * * * *